US005618173A

United States Patent [19]

Rühl et al.

[11] Patent Number: 5,618,173

[45] Date of Patent: Apr. 8, 1997

[54] APPARATUS FOR BURNING OXYGENIC CONSTITUENTS IN PROCESS GAS

[75] Inventors: Andreas Rühl, De Pere, Wis.; Gert Rentzel, Gelnhausen, Germany; Patrick McGehee, Green Bay, Wis.; Serguei Charamko, Potts Point, Australia; Kim Anderson, Green Bay, Wis.

[73] Assignee: W.R. Grace & Co.-Conn., New York, N.Y.

[21] Appl. No.: 356,600

[22] Filed: Dec. 15, 1994

[51] Int. Cl.[6] ..... F23M 9/00

[52] U.S. Cl. ..... 431/183

[58] Field of Search ..... 431/158, 182–184, 431/353, 174, 185

[56] References Cited

U.S. PATENT DOCUMENTS

| | | | |
|---|---|---|---|
| Re. 34,298 | 6/1993 | Gitman et al. | 431/5 |
| 2,124,175 | 7/1938 | Zink | 431/184 |
| 3,090,675 | 5/1963 | Ruff et al. | 23/277 |
| 3,115,851 | 12/1963 | Ceely | 431/174 |
| 3,311,456 | 3/1967 | Denny et al. | 23/277 |
| 3,549,333 | 12/1970 | Tabak | 23/277 C |
| 3,589,852 | 6/1971 | Buchanan | 431/158 |
| 3,637,343 | 1/1972 | Hirt | 23/2 C |
| 3,806,322 | 4/1974 | Tabak | 23/277 C |
| 3,838,975 | 10/1974 | Tabak | 23/277 C |
| 3,898,040 | 8/1975 | Tabak | 23/277 C |
| 4,003,692 | 1/1977 | Moore | 431/158 |
| 4,155,701 | 5/1979 | Primas | 431/183 |
| 4,303,386 | 12/1981 | Voorheis et al. | 431/183 |
| 4,364,724 | 12/1982 | Alpkvist | 431/11 |
| 4,365,951 | 12/1982 | Alpkvist | 431/82 |
| 4,850,857 | 7/1989 | Obermuller | 431/242 |
| 5,333,395 | 8/1994 | Bulcsu | 34/79 |
| 5,425,630 | 6/1995 | Dutescu et al. | 431/5 |

FOREIGN PATENT DOCUMENTS

| | | |
|---|---|---|
| 2037864 | 9/1991 | Canada . |
| 2352204 | 4/1975 | Germany . |
| 3043286A1 | 10/1981 | Germany . |
| 3332070A1 | 3/1985 | Germany . |

*Primary Examiner*—Carroll B. Dority

*Attorney, Agent, or Firm*—William L. Baker; Craig K. Leon; Kevin S. Lemack

[57] ABSTRACT

Process and apparatus for burning combustible constituents in process gas in a main combustion enclosure, preferably a thermal post-combustion device, whereby the main combustion enclosure is separated from a combustion chamber, into which oxygenic gas and gaseous fuel are fed, mixed and burnt. The fuel for the apparatus is fed through a lance which opens into a mixing chamber supplied with oxygenic gas, which is either itself the combustion chamber or merges with it, and the outer surface of the combustion chamber is exposed at least partially to the process gas. The fuel is burned completely or nearly completely in the burner combustion chamber and the mixture of burned fuel and gas leaving the combustion chamber oxidizes the combustible constitutes in the process gas flowing outside of the combustion chamber by yielding flameless heat energy to them.

12 Claims, 14 Drawing Sheets

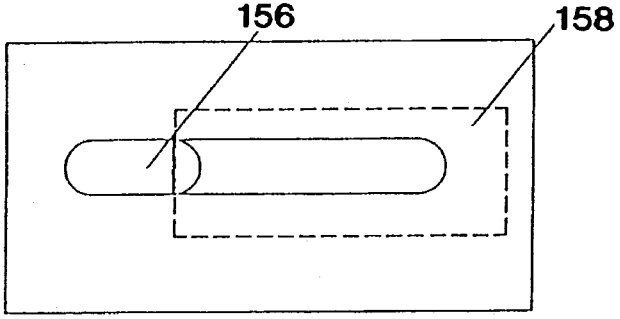
FIG. 7C
FIG. 7B
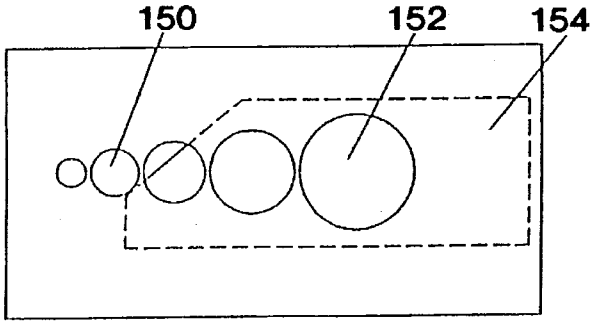
FIG. 7A (ONLY ONE BLADE SHOWN)

APPARATUS FOR BURNING OXYGENIC CONSTITUENTS IN PROCESS GAS

BACKGROUND OF THE INVENTION

Recently, environmental considerations have dictated that effluent released to atmosphere contain very low levels of hazardous substances; national and international NOx emission regulations are becoming more stringent. NOx emissions are typically formed in the following manner. Fuel-related NOx are formed by the release of chemically bound nitrogen in fuels during the process of combustion. Thermal NOx is formed by maintaining a process stream containing molecular oxygen and nitrogen at elevated temperatures in or after the flame. The longer the period of contact or the higher the temperature, the greater the NOx formation. Most NOx formed by a process is thermal NOx. Prompt NOx is formed by atmospheric oxygen and nitrogen in the main combustion zone where the process is rich in free radicals. This emission can be as high as 30% of total, depending upon the concentration of radicals present.

Post-combustion units, such as that disclosed in U.S. Pat. No. 4,850,857 (WO 87/014 34), the disclosure of which is hereby incorporated by reference, have been used to oxidize process effluent. Such post-combustion units have many uses in industry, for example in the printing industry, where exhaust fumes may contain environmentally hazardous substances. The burners currently in use, however, emit NOx gases.

In order to ensure the viability of thermal oxidation as a volatile organic compound (VOC) control technique, lower NOx emissions burners must be developed.

SUMMARY OF THE INVENTION

The present invention involves a process for burning combustible constituents in process gas in a main combustion enclosure, preferably a thermal post-combustion device, whereby the main combustion enclosure is separated from a combustion chamber, into which oxygenic gas and gaseous fuel are fed, mixed and burnt. The invention also involves a device for burning combustible constituents in process gas in a main combustion enclosure, preferably in a post-combustion unit with a burner, whereby the fuel can be fed through a lance which opens into a first or mixing chamber supplied with oxygenic gas, which is either itself the combustion chamber or merges with it, and whereby the outer surface of the combustion chamber is exposed at least partially to the process gas.

The present invention addresses the problem of developing a process and a device of the type mentioned at the outset, designed specifically for thermal post-combustion equipment in order to further reduce the amount of NOx in the carrier gas. At the same time a large turndown ratio, specifically greater than 1:20 of the burner capacity, can be achieved.

In terms of the process, the invention calls for the fuel to be burned completely or nearly completely in the burner combustion chamber and for the mixture of burned fuel and gas leaving the combustion chamber to oxidize the combustible constitutes in the process gas flowing outside of the combustion chamber by yielding flameless heat energy to them.

In contrast to the present state of the art, the fuel does not burn outside of the burner combustion chamber, but exclusively within the combustion chamber, which guarantees that the NOx contents are greatly reduced. The mixture of burnt fuel and gas remains hot enough to ignite the process gas which burns separate from the combustion chamber, specifically in the post-combustion device main combustion enclosure or in a high-speed mixing tube or flame tube connecting this with the combustion chamber.

Stated differently, the fuel and the process gas are burned physically separated. This measure insures that the NOx emissions are reduced.

In order to insure that the fuel is burned in the combustion chamber as efficiently as required, the invention also provides for the oxygenic gas flowing into the combustion chamber to spin around and envelope the fuel entering the combustion chamber, thus forming a turbulent diffusion swirl flame.

The invention also provides for the flame within the combustion chamber to be recirculated so that it remains inside the combustion chamber throughout the whole of the burner capacity's range of adjustment.

Even if the invention recommends feeding fresh air as oxygenic gas into the combustion chamber, alternate sources of combustion air may be used if sufficient oxygen is available to ensure complete combustion of the fuel. Regardless which oxygenic gas is used, however, the fuel is completely burned inside the combustion chamber.

The device accomplishes the task by the fact that the combustion chamber is part of the burner; at least part of the lance is located in a swirl chamber featuring a swirl generator consisting of swirl blades arranged axially to the lance; the swirl chamber connected to the first chamber is coaxial to the lance and features at least one oxygenic gas supply line positioned at a tangent or at a near tangent to its interior circumferential surface in one plane situated perpendicular to the longitudinal axis of the swirl chamber. The lance in this case may consist of coaxially arranged inner and outer pipes or at least two fuel supply pipes positioned side by side which end in the first chamber.

Various measures have been developed to reduce NOx levels. To improve feed control of fuel such as natural gas, a two-step fuel lance has been developed, the inner pipe being concentrically contained in the outer pipe or two pipes, preferably of two different diameters, are arranged side by side. Through the inner pipe, i.e., the pipe with the smaller diameter, ⅓ of the fuel flow, and through the outer pipe, i.e., the pipe with the larger diameter, ⅔. This ratio can be varied. Thus, it is possible to have the same amounts flow through the inner, small pipe, as through the outer, larger pipe. Ratios as large as ⅛ to ⅞ between the inner, i.e. smaller diameter and the outer, i.e., larger diameter pipe are also feasible.

Fuel supply is regulated by feeding the fuel through conventional valves, initiating the flow through the smaller pipe in the lance, i.e., the pipe with the smaller diameter. If operating considerations require greater burner capacity, the outer pipe with its larger diameter is used. Valve sequencing is critical to smooth burner operation.

Another result is that during minimum gas discharge, e.g., gas discharge solely from the inner or smaller pipe, the desired gas discharge velocity is maintained. The gas discharge velocity can therefore be kept within a velocity range permitting low NOx combustion to take place.

The inner pipe of the lance opening in the first chamber features preferably one axial single-hole nozzle, while the outer pipe has several outlet nozzles arranged in a concentric geometric pattern to the inner pipe. These nozzles of the outer pipe should be arranged so that the fuel comes out as close to the inner pipe as possible. Furthermore, the openings of the inner and outer pipe should be designed and/or arranged to keep pressure loss to a minimum. Finally, the end of the inner pipe featuring the axial single-hole nozzle is designed to protrude beyond the end of the outer pipe. When there are two pipes of different diameters side by side, the pipes may feature single nozzles or multiple nozzles arranged in a geometric pattern.

In either embodiment of the invention, the inner and outer pipes, or the pipes set side by side, are designed such that fuel emission velocity ranges between 10 and 150 m/s.

In another embodiment of the fuel lance, the fuel-supply pipe can include stopper featuring at least one shut-off nozzle with an adjustable diameter. Specifically, there are several openings in the nozzle either in a circle or along a straight line which can be adjusted properly using a rotating or sliding element. The main difference in this alternative embodiment is that gas velocity is held constant for a given supply pressure and that volume of fuel is controlled by the open area exposed by the rotating or sliding element.

In a further embodiment, the lance can be encased in a pipe containing at least one fuel-supply line, one pilot burner and/or a flame monitor.

The design of the device permits a wide control range of the heating capacity. Thus the min/max fuel supply can vary within a range from 1:20 to 1:60. This enables the burner's output to be adapted to changing process conditions.

A supplementary recommendation towards solving the problem addressed by the invention is that the oxygenic gas to be mixed with the fuel, referred to as air below, be fed into a swirl chamber where the air is submitted to a combined tangential and axial swirling motion.

The axial swirl motion, by which the air is given a twisting motion by the swirl chamber, is produced by several vanes or blades which describe an acute angle to the longitudinal axis of the fuel lance. The angle of the blades or vanes to the longitudinal axis can be modified so that the strength of the swirl can be adjusted as required.

In order to keep the swirling motion constant or nearly constant within the whole control range, the invention includes the recommendation that the air entering the swirl chamber be submitted to a tangential component. This is done by channeling the air in a spiral into the swirl chamber which is tapered towards the first chamber and features the extending vanes or blades described above which themselves are preferably mounted on the outer pipe of the lance by means of a fastening ring or cylinder. These vanes or blades feature a radial extension smaller than the radial size of the swirl chamber, creating tip clearance between blade and inner side. In addition, the blades can also be bent towards their tips and seen in the direction of air-flow, in order to give the turbulent flow a further swirl in the core space. Practically speaking, a swirl generated within a swirl.

The theory of the invention is also characterized by the sectional design of the combustion chamber which consists of a cylindrical mixing chamber where air is mixed with fuel, and the actual combustion chamber with a flat or tapered discharge.

In order to generate a stable flame in the combustion chamber, a characteristic of the invention should be emphasized which recommends that there be an abrupt change in diameter from the first, or mixing chamber, to the combustion chamber. This can be accomplished by a step shape. In this regard, the diameter of the combustion chamber, cylindrical in form, preferably should be about twice the size of the first or mixing chamber. The lengths of the individual chambers, by contrast, are dependent on the operating specifications of the burner. Preferably the ratio of the length of the mixing chamber to the length of the combustion chamber is 1:1 to 1:1.5, preferably 1:1.35. The abrupt change in the diameter causes hot combustion gases to recirculate, stabilizing the flame.

The exit of the combustion chamber can have a flat or conical profile which also contributes to flame stability. In this context, the diameter of the discharge opening should be approximately the same as the diameter of the mixing chamber.

To insure that the flame is recirculated within the combustion chamber, panels or similar swirl elements can also be arranged.

The outside of the combustion chamber may feature a cooling element such as fins which cools the chamber by transferring the heat to the circulating process gas. At the same time, the fins may be arranged to direct the process gas around the burner to maximize heat transfer.

Further details, advantages, and features of the invention are found not only in the claims, the features by themselves and/or in combination disclosed by them, but also in the following description.

BRIEF DESCRIPTION OF THE DRAWINGS

FIG. 7A is an alternative embodiment of the nozzle/valve configuration;

FIG. 7B is an alternative embodiment of the nozzle/valve configuration of FIG. 7A;

FIG. 7C is a side view detail of FIG. 7A and 7B;

DETAILED DESCRIPTION OF THE INVENTION

The figures, in which the same elements are basically given the same labels, show only in principle a burner (10) and details of it, which is intended for a thermal post-combustion device that is described by way of example in U.S. Pat. No. 4,850,857, and in principle shown in FIG. 13.

Figure 13:
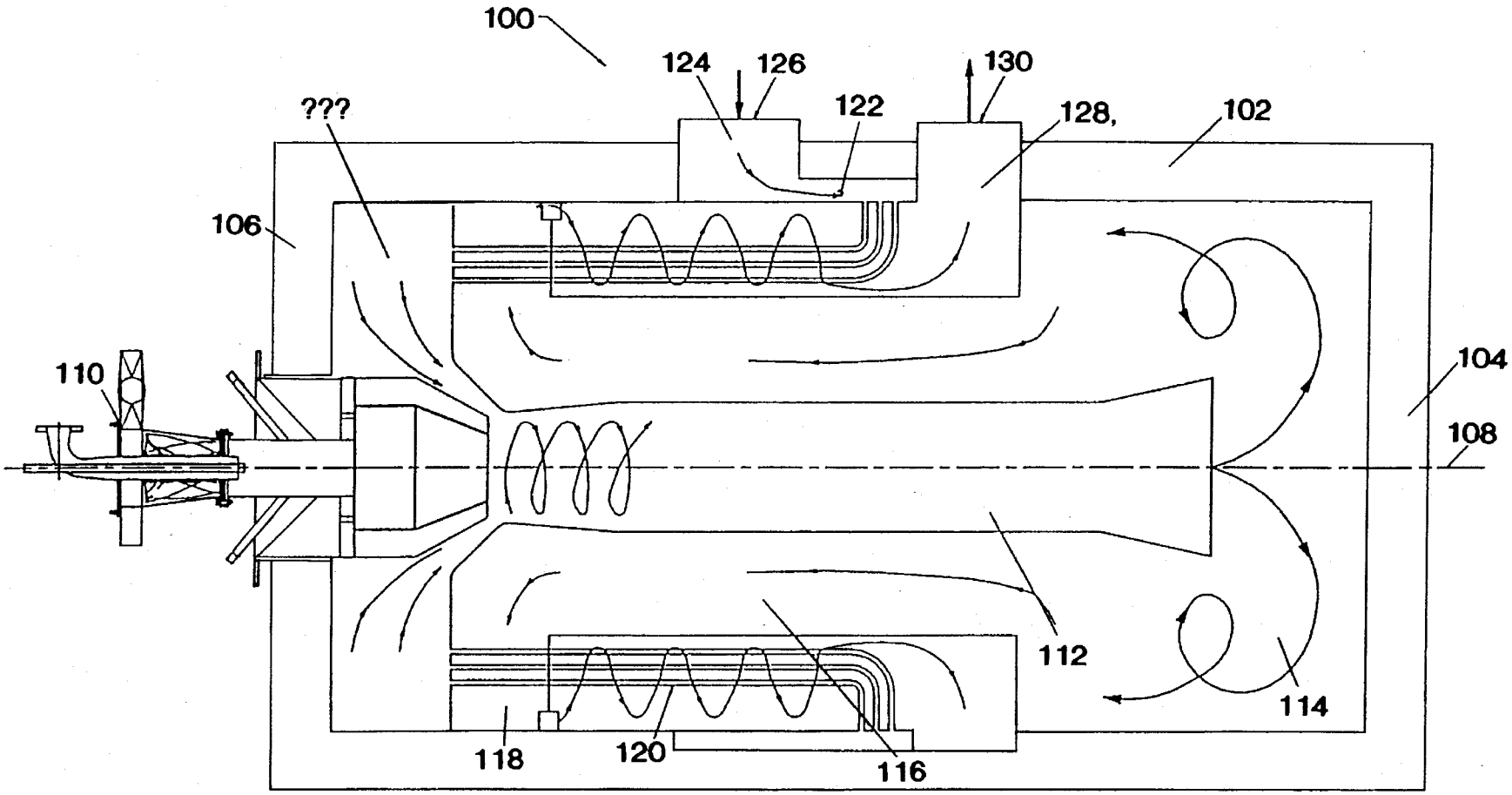
FIG. 13 is a cross-sectional view of the burner installed in a post-combustion thermal oxidizer, in accordance with the present invention.

Thus, as can be seen in FIG. 13, the unit (100) includes a cylindrical outer casing (102), which is limited by the facings (104 and 106). Near the facing (106) a burner (110), described in greater detail below, is positioned concentrically to the center axis (108) of the casing (102). This burner is connected preferably to a high speed mixing tube or flame tube (112) and a main combustion chamber (114) which is limited by the facing (104).

Situated concentrically to the high-speed mixing pipe (112), an inner ring-shaped space (116) merges with an enclosure (118) in which heat exchange/preburn lines (120) are arranged. The heat exchange/preburn lines (120) themselves open into an outer ringshaped enclosure (122) located along the outer side of the high-speed mixing pipe (112), said ring-shaped chamber connected to the inlet opening by a ring chamber (124) arranged concentrically to the burner (110). Facing the ring chamber (124) connected to the inlet opening (126) there is a further ring chamber (128) from which a discharge opening (130) issues.

In order to reduce NOx emissions from the unit (100), the following steps provide for the complete combustion of the fuel fed into the burner (110) inside the burner, i.e., inside the burner combustion chamber, while physically separated from this, the combustible constituents in the process gas fed into the unit do not come into direct contact with the fuel flame but are oxidized separately from it.

Figure 1:
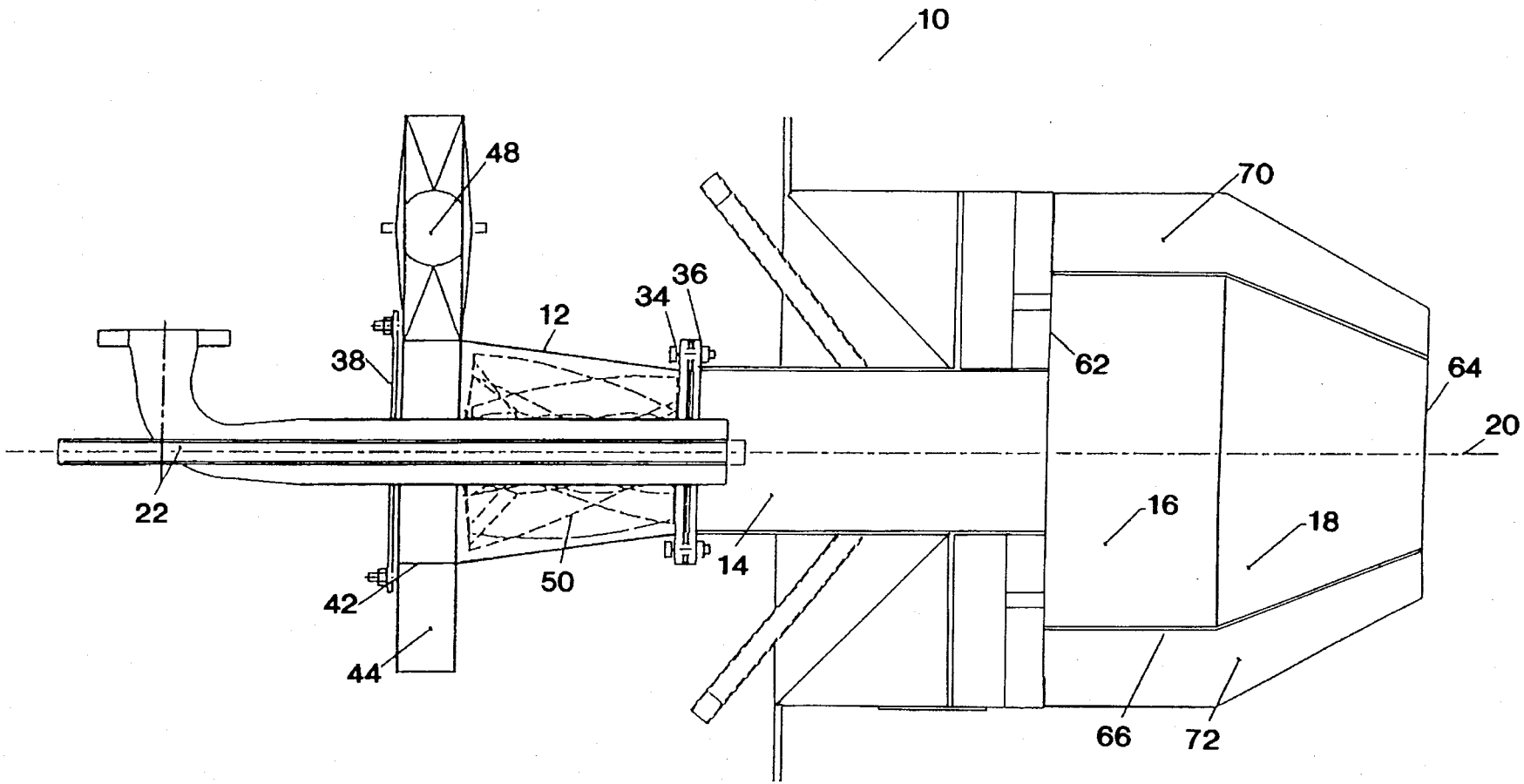
FIG. 1 is a cross-sectional view of the burner with conical discharge in accordance with the present invention.

Turning now to FIG. 1, the burner (10) pursuant to the invention comprises a spin or swirl chamber (12), a mixing or first chamber (14), and a combustion chamber (16) which includes a conically shaped outlet section (18).

Fuel such as natural gas, which is burned together with the combustion air, is fed in through the swirl chamber (12), and is introduced into the mixing chamber (14) through a lance (22) extending within the burner (10) along its longitudinal axis (20). Several embodiments of the lance (22) are possible, which will be discussed below.

Figure 2B:
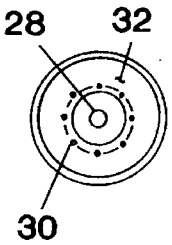
FIG. 2B is an end view showing the nozzle configuration of FIG. 2A.
Figure 2A:
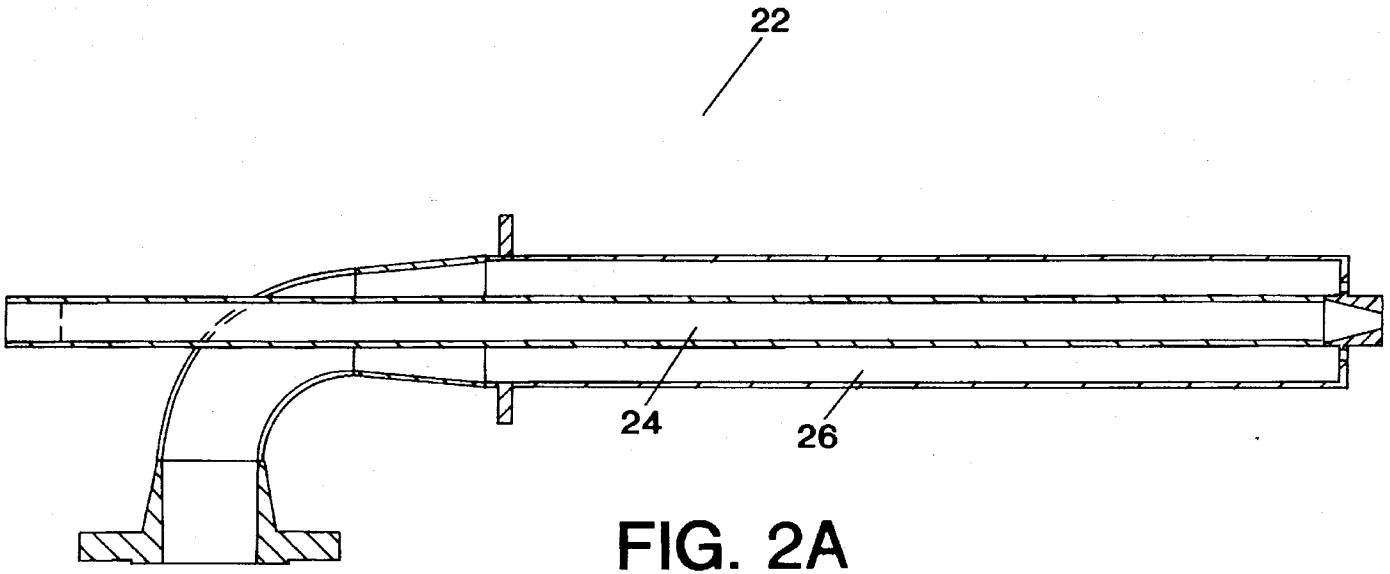
FIG. 2A is a cross-sectional view of a first embodiment of a fuel lance in accordance with the present invention.

The lance (22) according to FIG. 2A consists of an inner pipe (24) and an outer pipe (26) running coaxially to one another, with the inner pipe (24) projecting beyond the outer pipe (26). The inner and outer pipes (24) and (26) that have orifices (28) and (30) (FIG. 2B), respectively, end in the mixing chamber (14), which has a cylindrical shape, or in other words has an essentially constant cross section over its length. The orifice (28) of the inner pipe (24) is an axial single-opening nozzle, while the outer pipe (26) has several orifices (30) positioned in a circular geometric pattern (32) coaxial with the longitudinal axis of the lance (22), in such a way that the fuel fed through the outer pipe (26) is discharged as closely as possible to the inner pipe (24). The orifices (28) and (30) are designed so that only a small pressure loss occurs. Preferably, ⅔ of the fuel flows through the outer pipe (26) and ⅓ through the inner pipe (24). However, this ratio can also be varied. Thus, the fuel fractions can be divided equally between the inner and outer pipes (24) and (26), or in a ratio of ⅛ to ⅞ maximum. The rate at which the fuel exits the orifices (28) and (30) and enters the mixing chamber is dependent on fuel control valve position.

As an alternative (FIGS. 3A and 3B) the lance (22') may consist of two parallel pipes (24') and (26') running side by side which supply fuel as shown in the coaxial pipe arrangement. Furthermore, an additional pipe (27) (FIG. 3A) can be included for an UV opening at the end of the lance for detection of the flame. Finally, a fourth pipe (25) can be included to the installation of an ignition device (not shown).

In reference to the coaxial arrangement as per FIG. 2A, the pipe (24) corresponds to the inner pipe (24) and the pipe (26) to the outer pipe (26). The pipes (24), (26) can have unequal diameters.

Figure 3B:
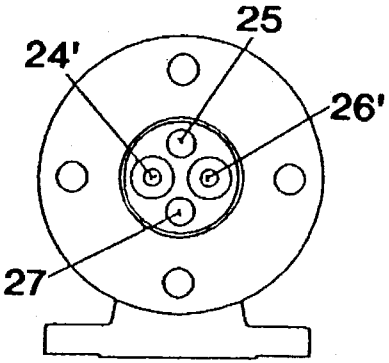
FIG. 3B is an end view showing the opening arrangement of FIG. 3A.

The pipes (24'), (26'), (25) and (27) can in this case be encased by a single pipe (29) as illustrated in FIG. 3B by the front view of the lance (22').

Figure 4B:
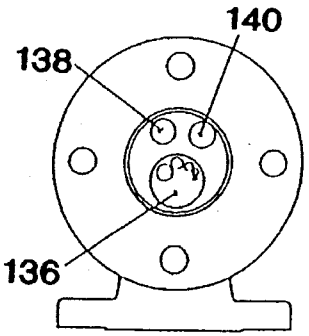
FIG. 4B is an end view showing the configuration of FIG. 4A.
Figure 4A:
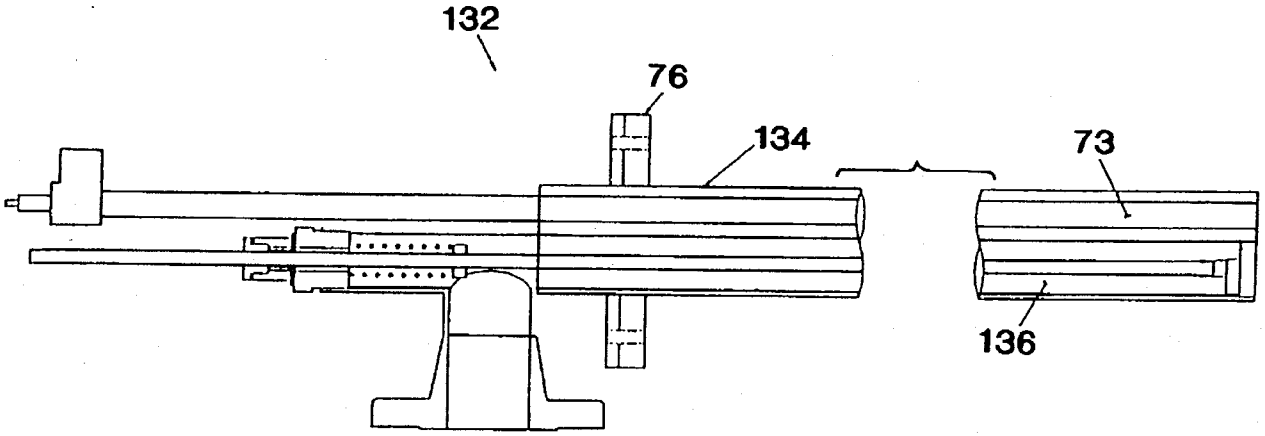
FIG. 4A is a further alternative embodiment of the fuel lance of the present invention, including a single variable nozzle valve, ignitor and view port.

A further lance embodiment (132) can be seen in FIG. 4A and 4B. Here the lance (132) consists of one outer pipe (134) in which a pipe (136) supplying fuel such as natural gas, a flame detector (138) and an ignition device (140) are arranged. The flame can be observed by the flame detector (138), preferably by a UV-sensor. The natural gas supply pipe (136) in the design example shown in FIG. 4B has a discharge nozzle arrangement which can correspond to the one in FIG. 6*a*. Thus, there are several discharge openings (142), (144) arranged in a circle which can be open or blocked by a rotating plate (146). In this manner the user is assured that he can control the quantity of fuel released. Because gas pressure is maintained constant to the fuel lance, quantity of fuel supplied is directly proportional to the open area of the nozzle.

Figure 3A:
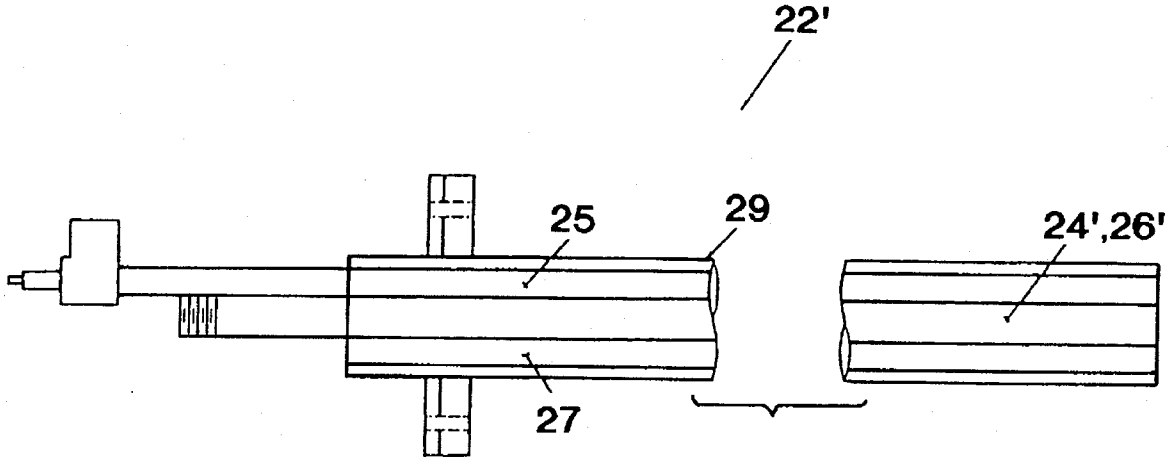
FIG. 3A is an alternative embodiment of the fuel lance of the present invention, including two discrete fuel nozzles, ignitor and view port.
Figure 5B:
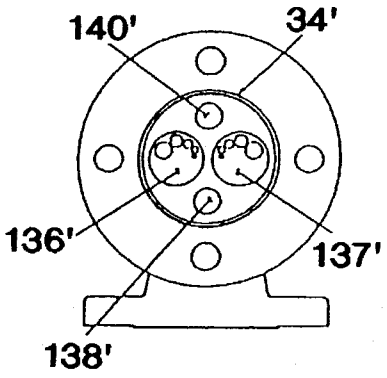
FIG. 5B is an end view showing the configuration of FIG. 5A.
Figure 5A:
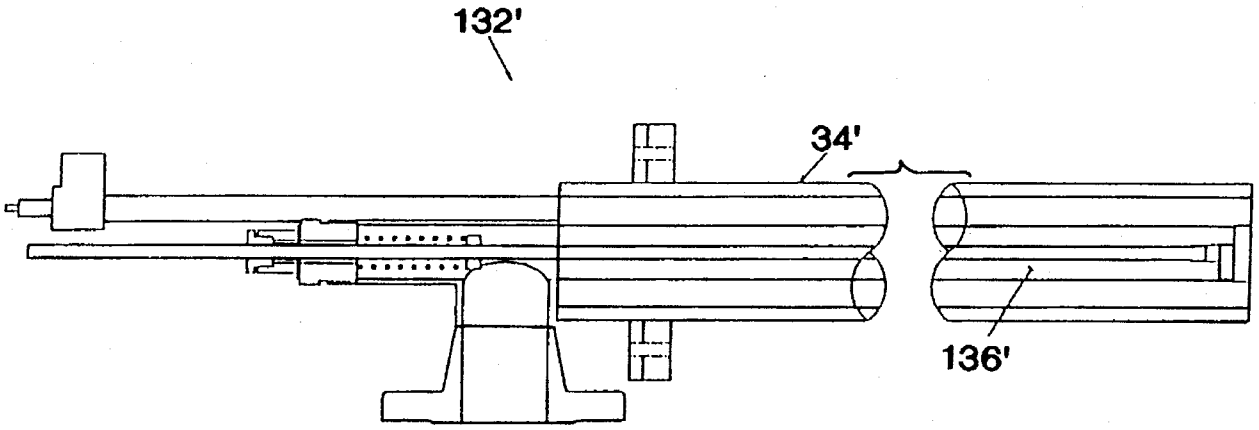
FIG. 5A is an even further alternative embodiment of the fuel lance of the present invention, including multiple variable nozzle valves, ignitor and view port.

FIGS. 5A and 5B illustrates a further lance embodiment which is a combination of the discharge nozzle designs shown in FIGS. 3A and 4A. Two pipes (136', 137') with the sliding shutter design are employed.

Figure 6C:
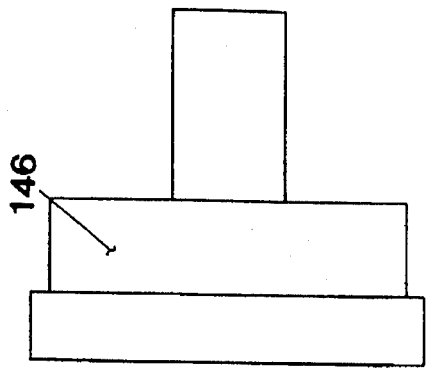
FIG. 6C is a side view detail of FIGS. 6A and 6B.
Figure 6B:
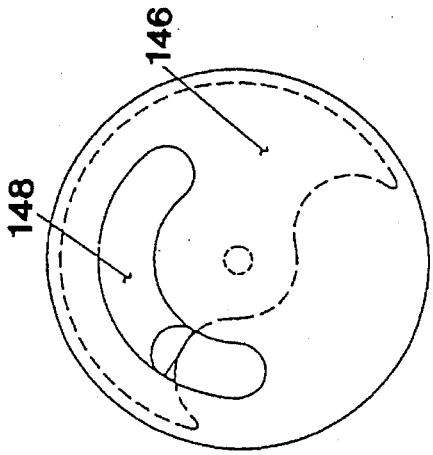
FIG. 6B is a detail of an additional embodiment of a nozzle/valve configuration.
Figure 6A:
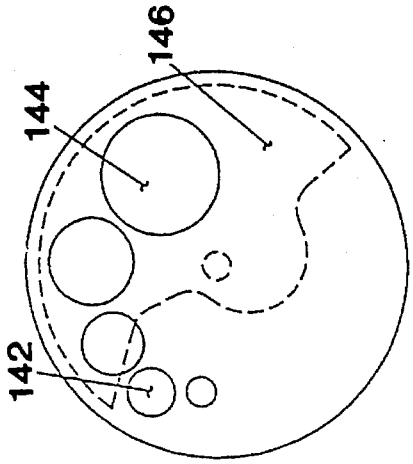
FIG. 6A is a detail of the preferred nozzle/valve configuration for the lance of FIGS. 4 and 5.

As an alternative, FIG. 6B shows a way of designing a discharge opening (148) shaped like a bent oblong for a fuel pipe. In this case, too, the aperture (148) can be opened and closed by means of the rotating plate (146).

Other discharge nozzle designs can be found in FIG. 7A and 7B. FIG. 7A, for example, shows discharge openings (150), (152) of unequal diameters arranged in a straight line which are closed or opened as required using a sliding plate (154). In FIG. 7B the cover of the fuel pipe features a narrow oblong opening (156) which can be closed as required with a sliding element (158).

As shown in FIG. 1, the lance (22) extends through the swirl chamber (12) and into the mixing chamber (14) where fuel exiting the lance (22) is subjected to combined tangential and axial swirling motion of the combustion air exiting the swirl generator (12). This swirling motion causes mixing of the fuel and air prior to the combustion chamber. This enables the air-fuel mixture in the combustion chamber (16),(18) to be burned so completely that only a low level of NOx can be emitted.

Figure 8B:
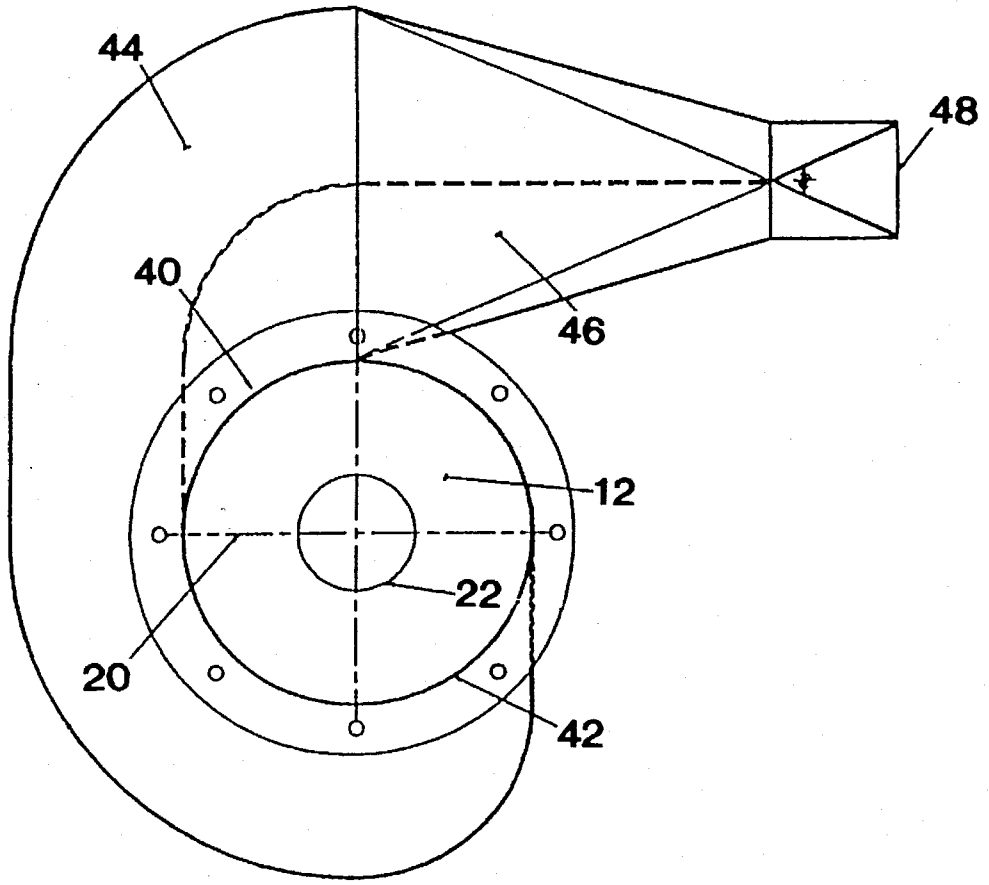
FIG. 8B is an end view of the swirl chamber of FIG. 8A.
Figure 8A:
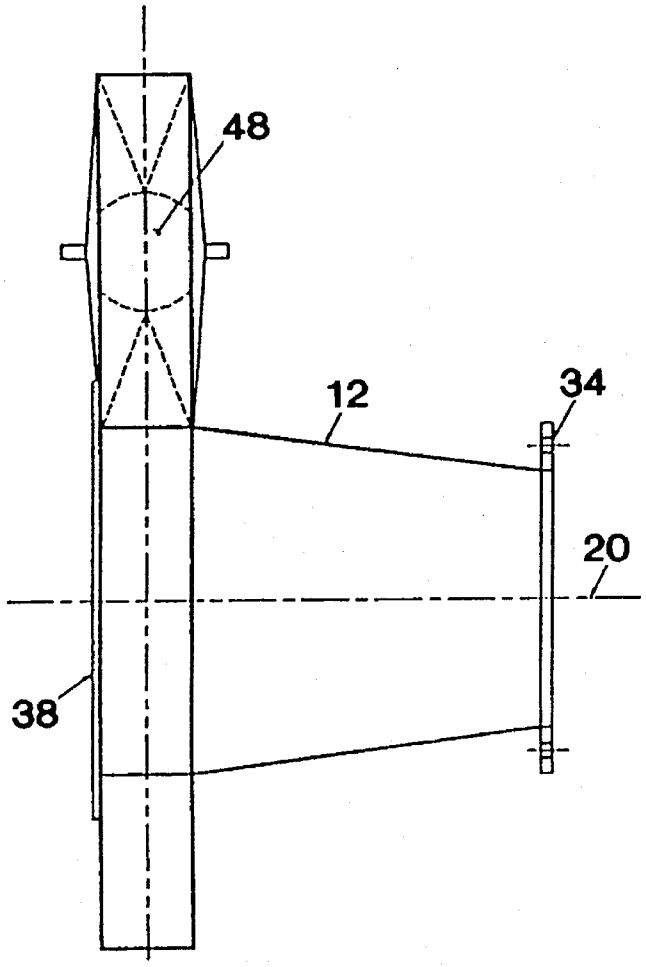
FIG. 8A is a cross-sectional view of a swirl chamber (without the swirl blades installed) in accordance with the present invention.

The swirl chamber (12) that merges into the first chamber or mixing chamber (14) and is sealed tightly to it by flanges (34) and (36), tapers down toward the mixing chamber (14). There are two air inlet orifices (40), (42) (FIG. 8B) diametrically opposite one another in the example of embodiment in the face (38) away from the mixing chamber (14), which originate from channels (44) and (46) arranged helically around the swirl chamber (12) in a plane perpendicular to its longitudinal axis, through a common opening (48) from which the necessary air is fed by a blower or fan (not shown). The air introduced into the swirl chamber (12) in a tangential plane perpendicular to the longitudinal axis (20) then experiences an axial deflection in the swirl chamber (12) by baffle plates and/or guide blades (50) (FIGS. 9A and 9B) or (52) (FIGS. 10A and 10B) positioned in it, which make an acute angle with the longitudinal axis (20) of the spin chamber (12) and thus of the burner (10) . The angle $\alpha$ that the baffles and/or guide vanes (50), (52) make with the longitudinal axis (22) can be set depending on the desired spinning motion to be imparted to the air.

The baffle plates or swirl blades (50), (52) themselves are mounted on a ring fastener or cylindrical fastener (54) or (56), which in turn surrounds the lance (22).

The radial extent of the swirl blades (50), (52) is smaller than that of the swirl chamber (12), so that there is a uniform distance between the outer edges (58) and (60) of the swirl blades (50), (52) and the inner wall of the swirl chamber (12).

Figure 9B:
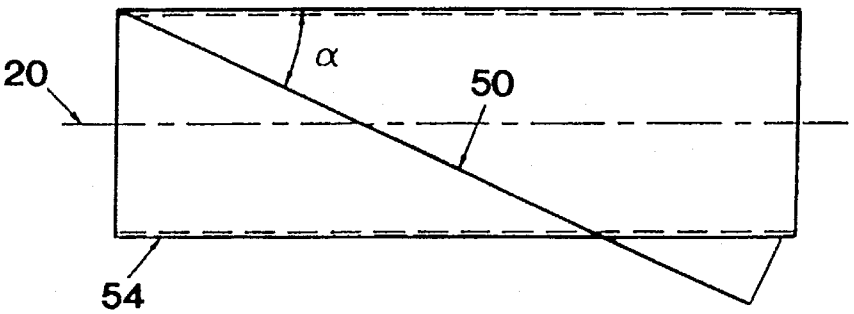
FIG. 9B is a side view of a single blade for the swirl generator shown in FIG. 9A.
Figure 9A:
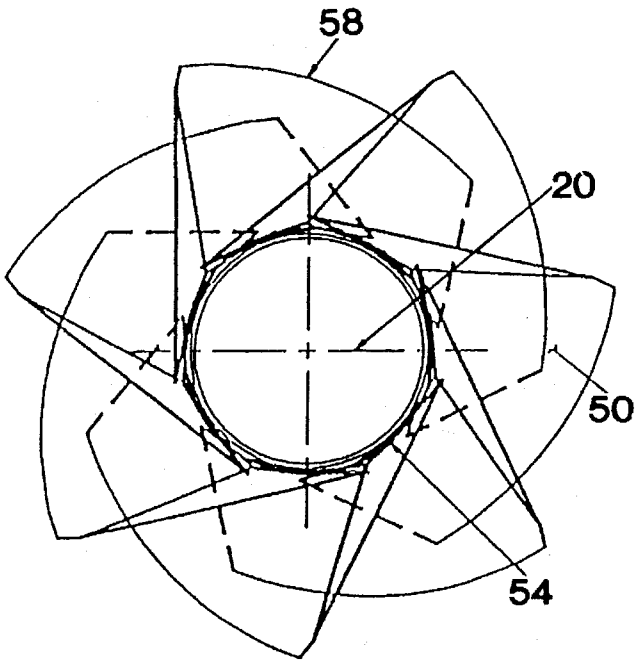
FIG. 9A is a front view of a first embodiment of a swirl generator to be incorporated into the swirl chamber in accordance with the present invention.
Figure 10B:
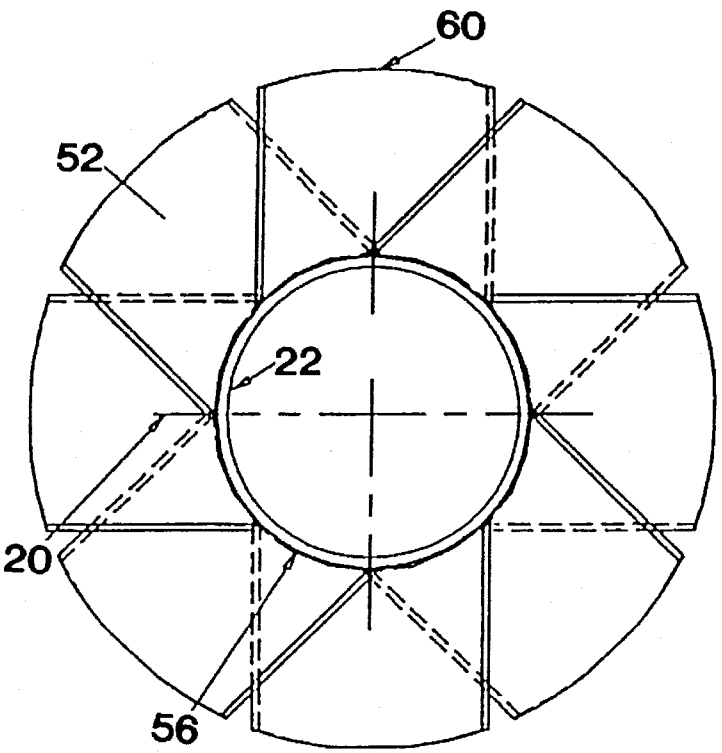
FIG. 10B is a side view of the swirl generator of FIG. 10A.
Figure 10A:
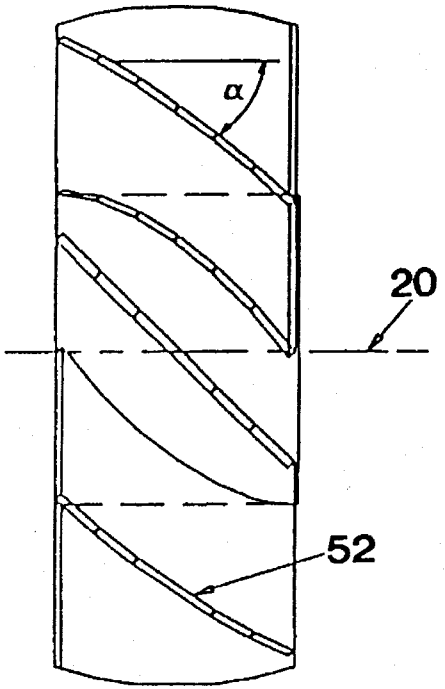
FIG. 10A is an alternative embodiment of a swirl generator for use in the swirl chamber of FIG. 8A.

Comparison of FIGS. 9A and 9B On the one hand and FIGS. 10A and 10B on the other hand also shows that the axial extent of the swirl blades (50), (52) of the design of the burner (10) can be selected appropriately. Naturally, the axial extent depends on the length of the particular swirl chamber (12).

Figure 14B:
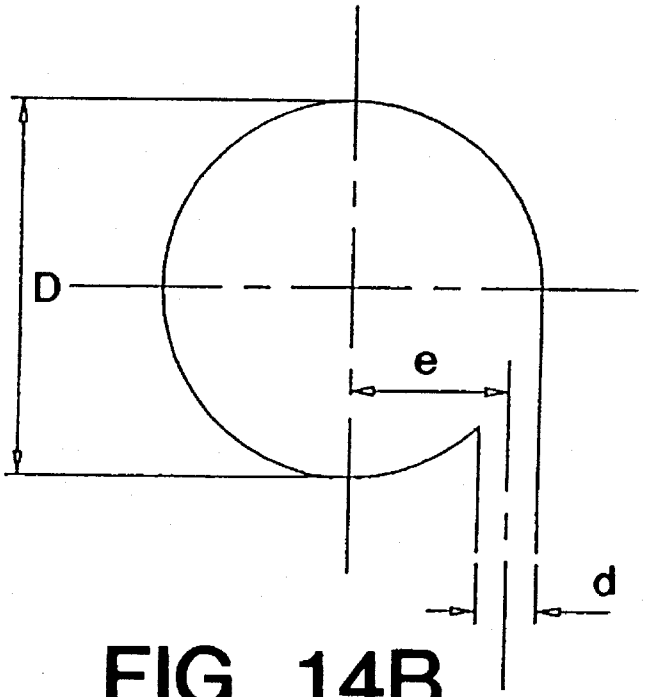
FIG. 14 shows the calculations for the axial and tangential swirl numbers in accordance with the present invention.
Figure 14A:
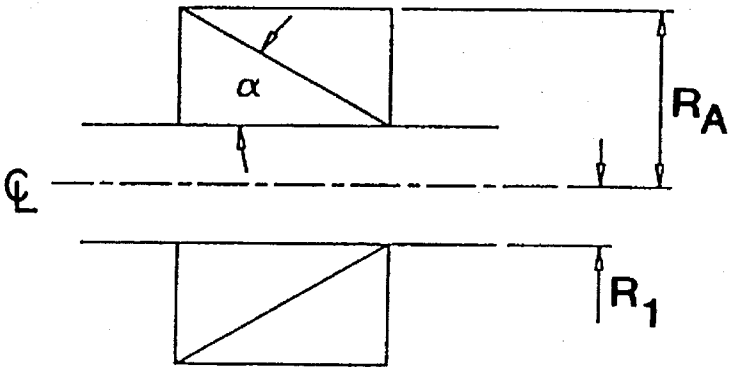

The swirl blades (50), (52) can be bent at their tips (by between 5° and 45° to the flat blade surface, preferably 25°) so that a swirl within a swirl can be generated. The number and angle of the blades can be varied to generate different swirl numbers. The axial swirl number ($S_{axial}$) and tangential swirl number ($S_{tangential}$) can be calculated as shown in FIG. 14. Swirl numbers from about 0.5 to about 5 may be used, with swirl numbers of 1.0 to 2.0 being preferred.

Figure 11B:
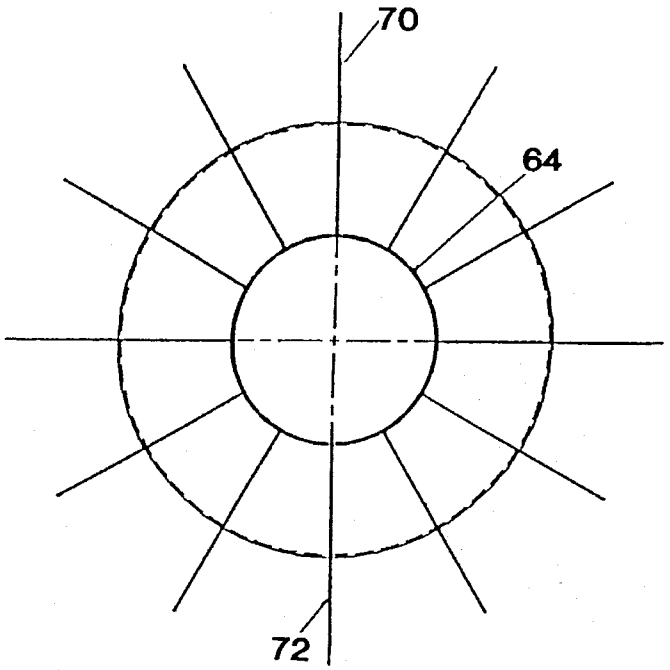
FIG. 11B is an end view of the chambers shown in FIG. 11A.
Figure 11A:
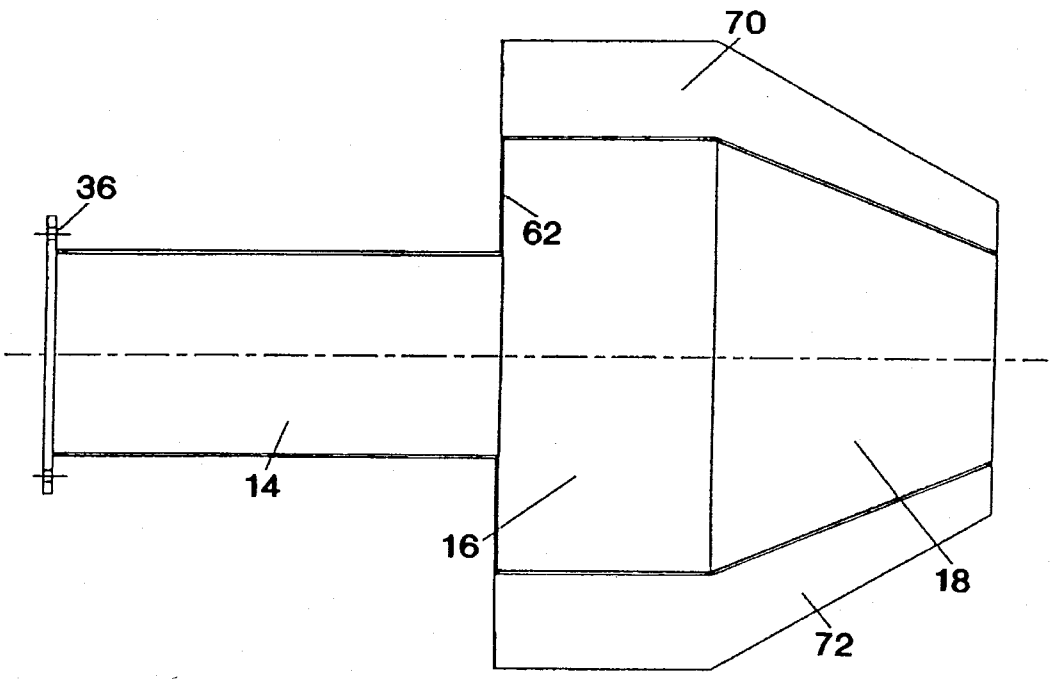
FIG. 11A is a cross-sectional view of the swirl mixing and combustion chamber of the burner assembly from FIG. 1, in accordance with the present invention.

The fuel discharged from the lance (22) is mixed to the necessary extent in the mixing chamber (14) with the air flowing through the swirl chamber (12), to be burned to the necessary extent in the combustion chamber (16). In order to produce a stable flame and thus a small NOx- and/or CO-fraction in the emitted gas, a discontinuous change of cross section occurs pursuant to the invention between the mixing chamber (14) and the connected combustion chamber (16), that likewise has a cylindrical shape. This change of cross section occurs by a step (62) as shown in FIG. 11A. This step achieves recirculation within the combustion chamber (16), which leads to stabilization of the flame, as mentioned. The diameter of the combustion chamber (16) is preferably about twice as large as that of the mixing chamber (14). The discharge section (18) tapering down conically toward the outside likewise brings about a stabilization of the flame. The cross section of the discharge opening (64) of the chamber (18) (FIG. 11B) is preferably about equal to the cross-section opening of the mixing chamber (14). Preferably the combustion chamber length to diameter ratio is from 1:1 to 4:1, most preferably 2:1. Too small a length will result in flame blow out. Too large a length will impair the stability of the unit.

Figure 12B:
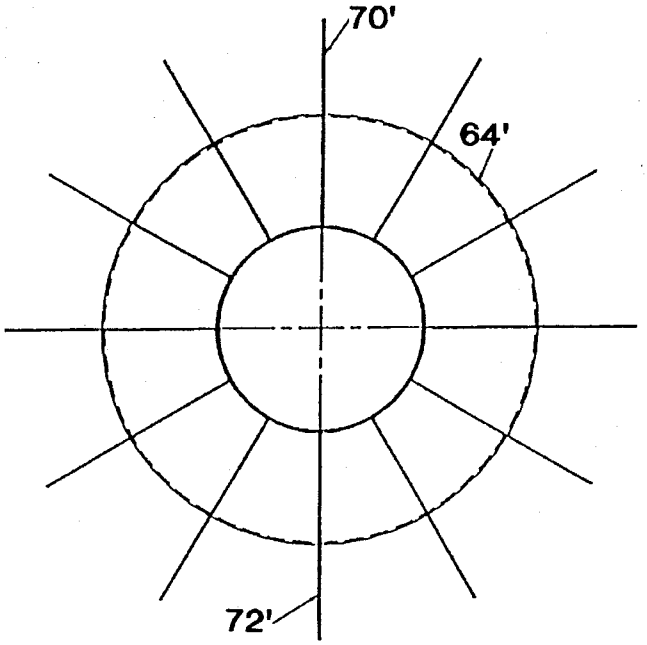
FIG. 12B is an end view of the chambers shown in FIG. 12A.
Figure 12A:
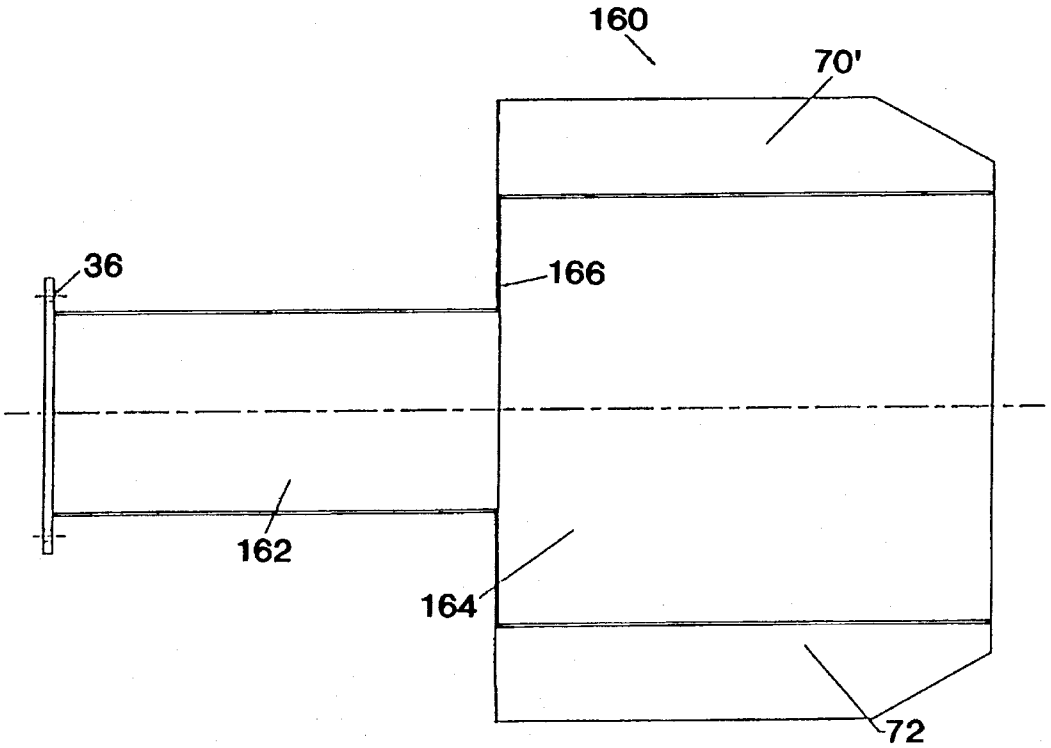
FIG. 12A is an alternative embodiment of the swirl mixing and combustion chambers shown in FIG. 11A.

The preferred configuration of the burner combustion chamber (16) is illustrated by FIG. 12. Two cylindrical chambers (162, 164) are connected by a step change (166). Velocities may vary from 20 to 200 meters per second (m/sec), with a preferred full flow (fuel at the high firing rate and combustion air preferred at 1.05 stoichiometric ratio) velocity of 100 m/sec. Preferably the ratio of combustion chamber (16) diameter to cylinder (162) diameter is 2:1, although the operative ratio range is from 1:1 to 1:4.

All of these measures guarantee that the flame initially generated as a diffusion turbulent swirl flame within the combustion chamber is recirculated, insuring that the fuel discharged by the lance is completely burned in the combustion chamber. However, the hot gas emitted by the combustion chamber is characterized by an energy level sufficient for igniting the process gas flowing outside the combustion chamber. The burning of the combustible constituents present in the process gas are kept thereby separate from the flame generated within the combustion chamber.

Another point is that a cooling facility such as cooling fins (70, 72) and (70', 72') extend in an axial direction from the outer sides (66) and (68) of the combustion chamber (16). These radiate heat to the process gas flowing around the outer surface (66) and (68) and, in turn, cool the combustion chamber (16) and (18). These fins also can be positioned such that they channel the process flow around the combustion chamber (16) and (18) and into the flame tube (112).

On condition that the burner (10) is set up to generate a Type I-flame as defined by combustion engineering standards, swirling combustion air is supplied to the fuel, such as natural gas, flowing out of the lance (12) in the approximate stoichiometric ratio of $\lambda$=1.05. Operation of the burner at other stoichiometric ratios is possible but requires modification to the area of the swirl devices and chambers. Excessive combustion air reduces the operational efficiency of the burner.

What is claimed is:

1. A burner comprising a swirl chamber having a longitudinal axis; a cylindrical combustion chamber; a cylindrical mixing chamber of a diameter substantially less than said combustion chamber in communication with said swirl chamber and said combustion chamber, said swirl chamber including swirl means comprising a plurality of vanes arranged axially to said combustion chamber; means for introducing oxygenic gas into said swirl chamber in a direction approximately tangential to said swirl chamber longitudinal axis; said swirl means in said swirl chamber generating a swirl of the whole amount of said oxygenic gas; means for introducing supplementary gaseous fuel into said mixing chamber; whereby said swirling oxygenic gas mixes flamelessly with said supplementary gaseous fuel in said mixing chamber and proceeds to said combustion chamber where said mixture is burned.

2. The burner of claim 1, wherein said swirl chamber is tapered in the direction of said mixing chamber.

3. The burner of claim 1, wherein said burner has a longitudinal axis, and wherein said plurality of vanes are curved so as to form an angle 0° to 90° to said longitudinal axis of said burner.

4. The burner of claim 3, wherein said plurality of vanes are bent at an angle 5° to 45° to the plane of said vanes.

5. The burner of claim 1, wherein said combustion chamber comprises a tapered discharge section at its end remote from said mixing chamber.

6. The burner of claim 1, wherein said combustion chamber has an outlet having a diameter d3, said mixing chamber has a diameter d1, and wherein the ratio of d1 to d3 is from 1:0.75 to 1:2.

7. The burner of claim 1, wherein said means for introducing fuel into said mixing chamber comprises a lance positioned along said swirl chamber longitudinal axis and having inner and outer coaxially arranged pipes.

8. The burner of claim 7, wherein the fuel flowing through said inner pipe is ⅓ of the total fuel flow.

9. The burner of claim 7, wherein said inner pipe includes a single fuel discharge nozzle, and said outer pipe includes a plurality of fuel discharge nozzles concentrically arranged about said inner pipe.

10. The burner of claim 7, wherein said inner pipe of the lance comprises a central aperture for the fuel to exit.

11. The burner of claim 10, wherein said outer pipe of the lance comprises a plurality of outlets disposed in a circular geometric pattern concentrically to said inner pipe.

12. The burner of claim 1, wherein said means for introducing fuel into said mixing chamber comprises a lance having two side-by-side pipes.

* * * * *